US005377710A

United States Patent [19]

Laser

[11] Patent Number: 5,377,710

[45] Date of Patent: Jan. 3, 1995

[54] TEMPORARY CRUTCH TIP CLEAT ASSEMBLY

[76] Inventor: Jay M. Laser, 3100 Windsor Dr., Landisville, Pa. 17538-1341

[21] Appl. No.: 258,548

[22] Filed: Jun. 10, 1994

[51] Int. Cl.[6] ..... A45B 3/00

[52] U.S. Cl. ..... 135/66; 135/78

[58] Field of Search ..... 135/77, 78, 65, 66, 135/68

[56] References Cited

U.S. PATENT DOCUMENTS

| | | | |
|---|---|---|---|
| 1,276,231 | 8/1918 | LeCras | 135/78 X |
| 1,504,902 | 8/1924 | Rosenhein, Jr. | 135/78 |
| 2,631,597 | 3/1953 | Phinney | 135/78 |
| 3,467,117 | 9/1969 | Lucibello . | |
| 4,098,283 | 7/1978 | Trittle, Jr. . | |
| 4,434,808 | 3/1984 | Burak . | |
| 4,450,850 | 5/1984 | McKenna . | |
| 4,708,154 | 11/1987 | Edwards . | |
| 4,964,430 | 10/1990 | Janis | 135/68 X |
| 5,119,688 | 6/1992 | Snyder, Jr. | 135/77 X |

FOREIGN PATENT DOCUMENTS

| | | | |
|---|---|---|---|
| 1023240 | 12/1977 | Canada | 135/78 |
| 1632518 | 2/1970 | Germany | 135/78 |

*Primary Examiner*—Lanna Mai

[57] ABSTRACT

Disclosed is a temporary crutch tip cleat assembly for preventing lateral slippage of a ground engaging tip of a crutch during use on icy and/or snowy supporting surfaces. The temporary crutch cleat assembly has a stud plate attachable to a ground engagement surface of a crutch tip for piercing engagement with ice and/or snow covered ground surfaces. The stud plate has a discoid plate having a plurality of sharp teeth projecting downwardly therefrom. The plate further has an essentially tubular wall extending oppositely the teeth, around the circumference thereof, to define a cup-shaped receptacle wherein the crutch tip may be inserted for keeping the plate in alignment with the crutch tip. The stud plate may be removably attached to the crutch with a pair of resilient flexible bands. The first end of each band is looped through a lateral hole of the stud plate wall while the second end has an enlarged knot for jamming within the v-shaped juncture of a convergent pair of crutch arm support members. The stud plate is secured to the crutch by the longitudinal bias of the taut bands.

7 Claims, 4 Drawing Sheets

TEMPORARY CRUTCH TIP CLEAT ASSEMBLY

BACKGROUND OF THE INVENTION

1. Field of the Invention

The present invention relates to ground engaging tips for crutches, canes, walkers, and the like and more particularly pertains to a temporary crutch tip cleat assembly which may be adapted for preventing lateral slippage of a ground engaging tip of a crutch during use on icy and/or snowy supporting supporting surfaces.

2. Description of the Prior Art

The use of ground engaging tips for crutches, canes, walkers, and the like is known in the prior art. More specifically, ground engaging tips for crutches, canes, walkers, and the like heretofore devised and utilized for the purpose of preventing lateral slippage of the device to which attached are known to consist basically of familiar, expected and obvious structural configurations, notwithstanding the myriad of designs encompassed by the crowded prior art which have been developed for the fulfillment of countless objectives and requirements.

The present invention is directed to improving devices for preventing lateral slippage of the device to which attached in a manner which is safe, secure, economical and aesthetically pleasing.

Relevant prior art patents include U.S. Pat. No. 4,450,850 to McKenna which describes a crutch for use on an icy surface and U.S. Pat. No. 4,098,283 to Tritle, Jr. disclosing specialized crutch tips.

The prior art also discloses an anti-skid device for a cane, crutch, or the like as shown in U.S. Pat. No. 4,434,808 to Burak, a nonslip crutch foot assembly in U.S. Pat. No. 4,708,154 to Edwards, and a crutch tip of U.S. Pat. No. 3,467,117 to Lucibello.

While these devices fulfill their respective, particular objectives and requirements, the aforementioned patents do not disclose a temporary crutch tip cleat assembly for preventing lateral slippage of a ground engaging tip of a crutch during use on icy and/or snowy supporting surfaces. Furthermore, the inventions or certain embodiments thereof disclosed in the Burak, Tritle, Jr., and McKenna patents include relatively long exposed sharpened projections which could cause injury to the user or surrounding people.

In this respect, the temporary crutch tip cleat assembly according to the present invention substantially departs from the conventional concepts and designs of the prior art, and in so doing provides an apparatus primarily developed for the purpose of preventing lateral slippage of a ground engaging tip of a crutch during use on icy and/or snowy supporting surfaces.

Therefore, it can be appreciated that there exist a continuing need for a new temporary crutch tip cleat assembly which can be used for preventing lateral slippage of a ground engaging tip of a crutch during use on icy and/or snowy supporting surfaces. In this regard, the present invention substantially fulfills this need.

As illustrated by the background art, efforts are continuously being made in an attempt to develop devices for preventing lateral slippage of crutches and canes. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of ground engaging tips for crutches, canes, walkers, and the like now present in the prior art, the present invention provides a new ground engaging tip for crutches, canes, walkers, and the like construction wherein the same can be utilized for preventing lateral slippage of a ground engaging tip of a crutch during use on icy and/or snowy supporting surfaces. As such, the general purpose of the present invention, which will be described subsequently in greater detail, is to provide a new temporary crutch tip cleat assembly apparatus and method which has all the advantages of the prior art ground engaging tips for snitches, canes, walkers, and the like and none of the disadvantages.

The invention is defined by the appended claims with the specific embodiment shown in the attached drawings. For the purpose of summarizing the invention, the invention may be incorporated into a temporary crutch tip cleat assembly for preventing lateral slippage of a ground engaging tip of a crutch during use on icy and/or snowy supporting surfaces. The temporary crutch cleat assembly comprises a stud plate attachable to a ground engagement surface of a crutch tip for piercing engagement with ice and/or snow covered ground surfaces.

The stud plate comprises a generally horizontal discoid plate formed of rigid material and having a plurality of sharp teeth projecting downwardly perpendicular the major plane thereof. The plate also has a diameter corresponding to the outside diameter of the crutch tip. The plate further has an essentially tubular generally straight wall extending oppositely the teeth around the circumference thereof defining a cup-shaped receptacle wherein the crutch tip may be inserted for keeping the plate in alignment with the crutch tip. The wall has a pair of lateral holes formed through opposing sides thereof intermediate a wall rim and the discoid plate.

Attachment means, whereby the stud plate may be removably attached to the crutch, comprises a pair of essentially identical resilient flexible bands, each band having a loop formed on a first end thereof. Each loop extends through one of the lateral holes of the stud plate wall whereby securing the bands to the plate. Each band also has an enlarged knot formed on a second end thereof whereby the second end may be secured to the crutch by jamming the knot within the V-shaped juncture of a convergent pair of crutch arm support members. The stud plate is secured to the crutch by the longitudinal bias of the taught bands.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a temporary crutch tip cleat assembly for preventing lateral slippage of a ground engaging tip of a crutch during use on icy and/or snowy supporting surfaces.

It is another object of the present invention to provide a new temporary crutch tip cleat assembly which may be easily and efficiently manufactured and marketed.

It is a further object of the present invention to provide a new temporary crutch tip cleat assembly which is of a durable and reliable construction.

An even further object of the present invention is to provide a new temporary crutch tip cleat assembly which is susceptible of a low cost of manufacture with regard to both materials and labor, and which accordingly is then susceptible of low prices of sale to the consuming public, thereby making such temporary crutch tip cleat assemblies economically available to the buying public.

Still yet another object of the present invention is to provide a new temporary crutch tip cleat assembly which provides in the apparatuses and methods of the prior art some of the advantages thereof, while simultaneously overcoming some of the disadvantages normally associated therewith.

Still yet another object of the present invention is to provide a temporary crutch tip cleat assembly that is adapted to work with a variety of crutches without requiring modification to the cleat assembly or the crutch.

Yet another object of the present invention is to provide a temporary crutch tip cleat assembly that may be quickly and easily installed and removed from the crutch as usage conditions change.

Even still another object of the present invention is to provide a temporary crutch tip cleat assembly that does not require the user to acquire additional skills for proper use thereof.

Yet still another object of the present invention is to provide a temporary crutch tip cleat assembly that does not use long spikes or other potentially hazardous components.

These together with other objects of the invention, along with the various features of novelty which characterize the invention, are pointed out with particularity in the claims annexed to and forming a .part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
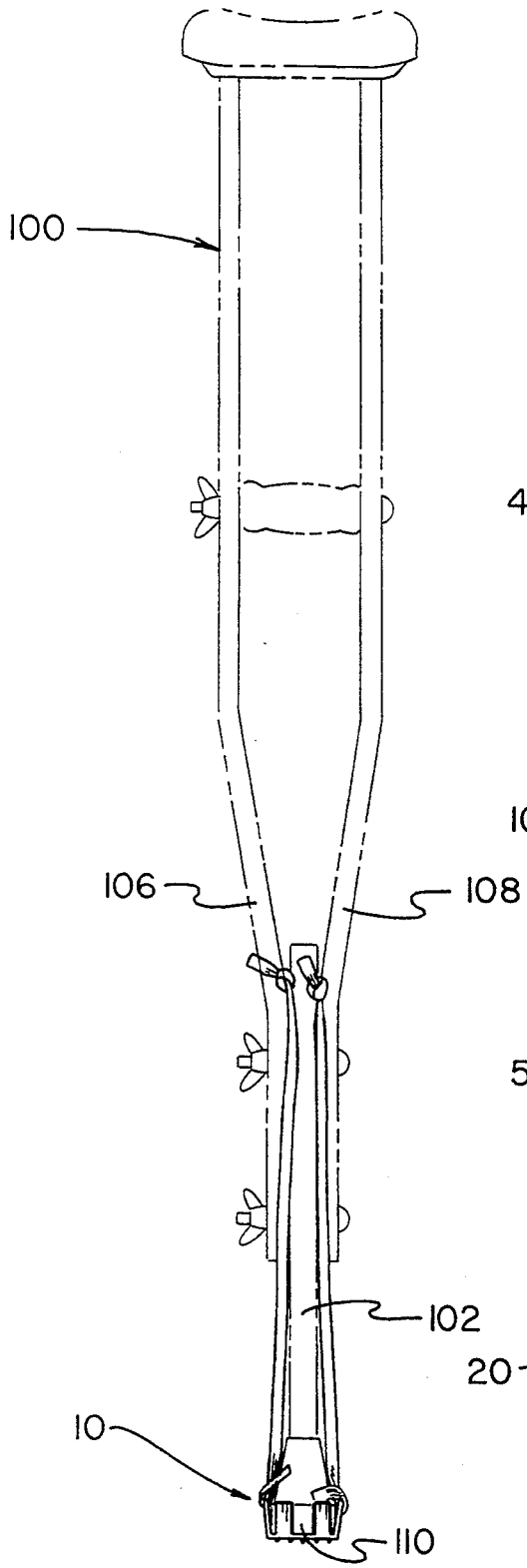
FIG. 1 is a side elevational view of the preferred embodiment of the temporary crutch tip cleat assembly showing its manner of installation on a typical wooden crutch.

With reference now to the drawings, and in particular to FIG. 1 thereof, a temporary crutch tip cleat assembly embodying the principles and concepts of the present invention and generally designated by the reference numeral 10 will be described.

Figure 2:
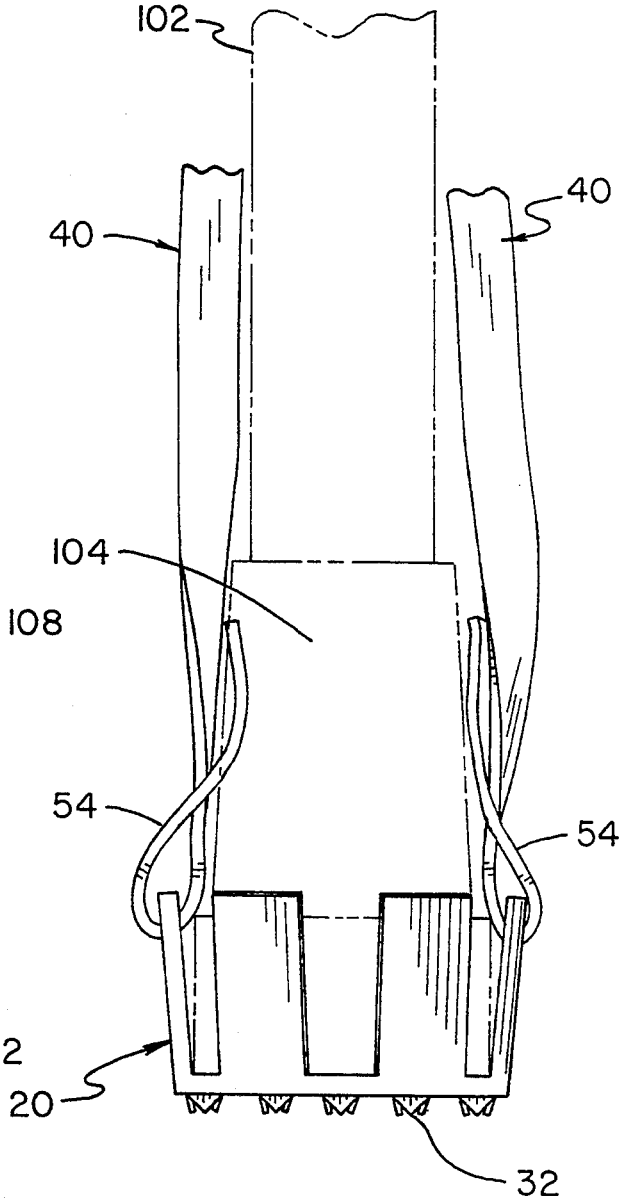
FIG. 2 is a partial side elevational view of the invention of FIG. 1 enlarged for clarity.
Figure 3:
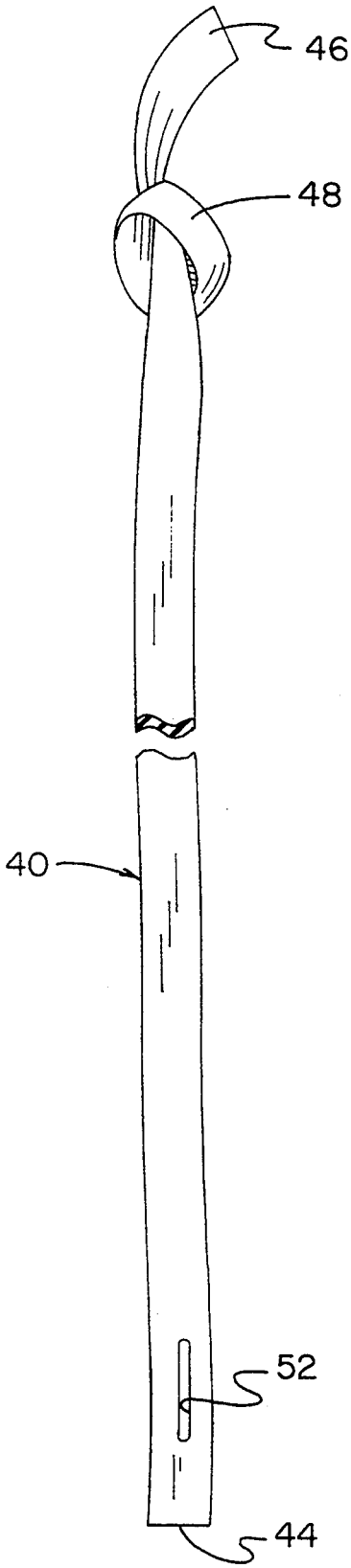
FIG. 3 is a side elevational view of a resilient attachment band of the invention of FIG. 1.
Figure 4:
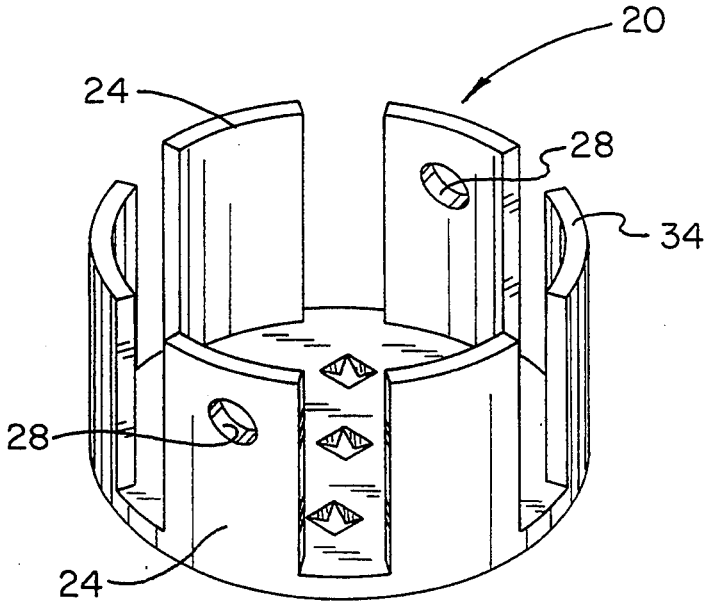
FIG. 4 is a top perspective view of the stud plate of the invention of FIG. 1.
Figure 5:
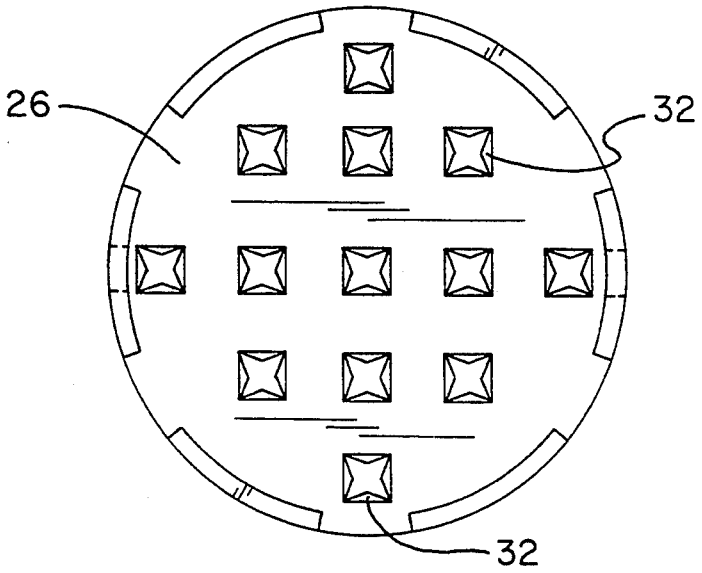
FIG. 5 is a top plan view of the stud plate of FIG. 4.
Figure 6:
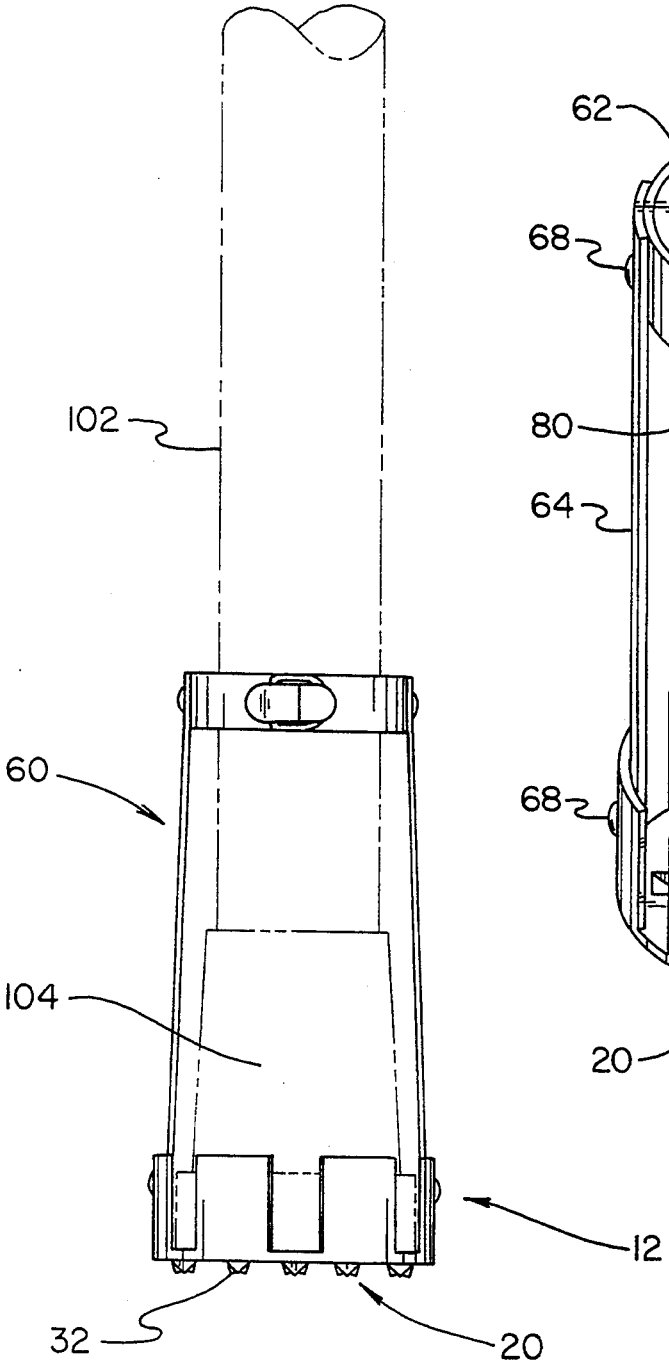
FIG. 6 is a side elevational view of an alternate embodiment of the present invention wherein the attachment means comprises a latchable circular band.
Figure 7:
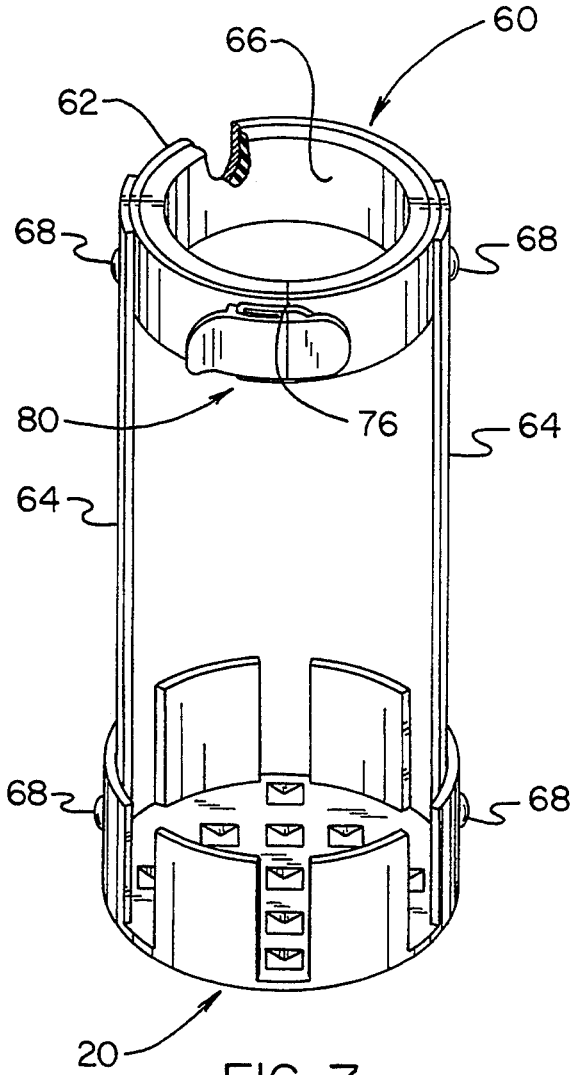
FIG. 7 is a top perspective view of the invention of FIG. 6.
Figure 8:
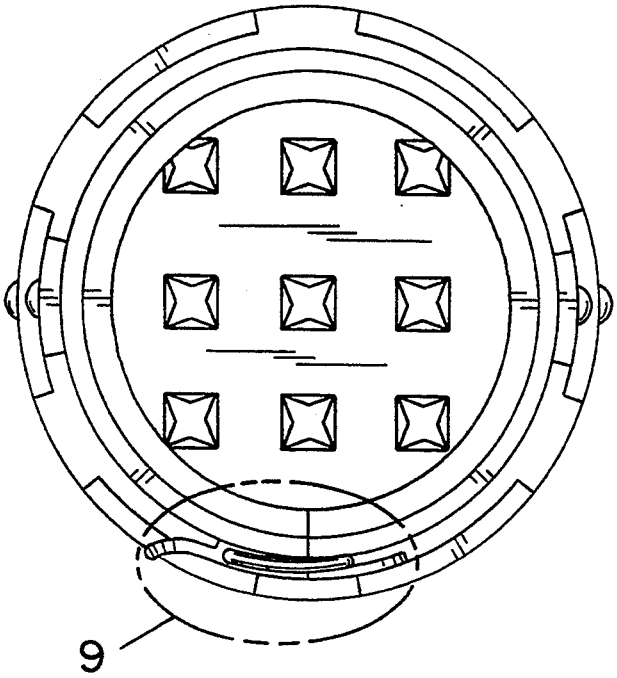
FIG. 8 is a top plan view of the invention of FIG. 6.
Figure 9:
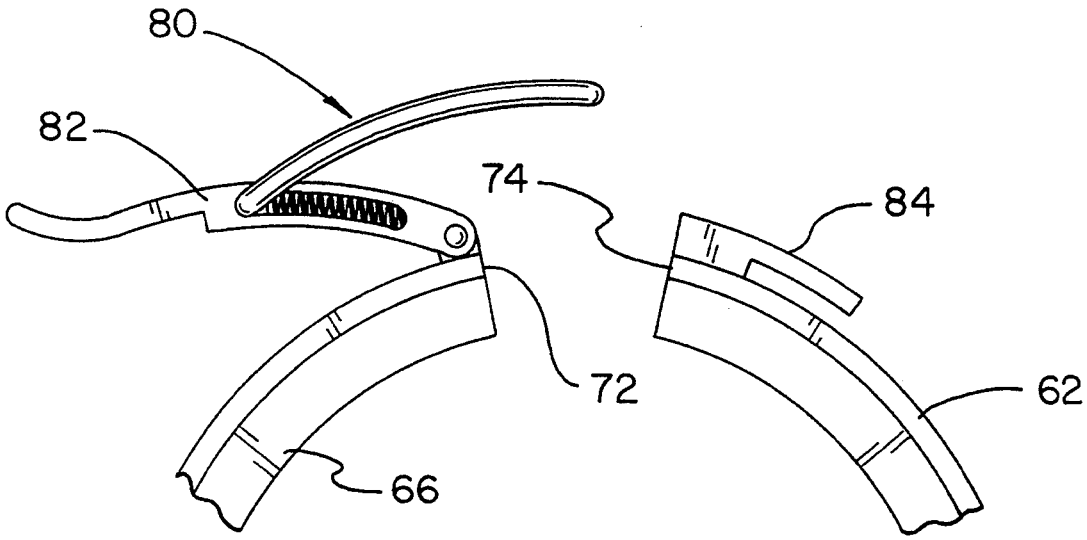
FIG. 9 is a detail view of the invention of FIG. 8 showing the toggle latch securement enlarged for clarity.

From an overview standpoint, the temporary crutch tip cleat assembly is adapted for use for preventing lateral slippage of a ground engaging tip of a crutch during use on icy and/or snowy supporting surfaces. See FIG. 2.

With reference now to FIGS. 1–5 and more specifically, it will be noted that a temporary crutch tip cleat assembly 10 is shown. The temporary crutch cleat assembly 10 comprises a stud plate 20 attachable to a ground engagement surface 110 of a crutch tip 104 for piercing engagement with ice and/or snow covered ground surfaces.

The stud plate 20 comprises a generally horizontal discoid plate 26 formed of sheet metal and having a plurality of integrally formed sharp teeth 32 comprising ragged burrs resulting from piercing of the sheet metal with a punch. The teeth 32 project downwardly, perpendicular the major plane of the discoid plate 26. The discoid plate 26 also has a diameter corresponding to the outside diameter of the crutch tip 104. The plate 26 further has an essentially tubular generally straight wall 24, formed from a plurality of integral radial tabs bent perpendicular the plate 26, extending oppositely the teeth 32 around the circumference thereof to define a cup-shaped receptacle wherein the crutch tip 104 may be inserted for keeping the plate 26 in alignment with the crutch tip 104. The wall 24 has a pair of lateral holes 28 formed through opposing sides thereof intermediate a wall rim 34 and the discoid plate 26.

Attachment means, whereby the stud plate 20 may be removably attached to the crutch 100, comprises a pair of essentially identical resilient flexible rubber bands 40, each band having a loop 54 formed on a first end thereof by looping the band 40 back through a longitudinal slot 52 formed on its own first end 44. The loop 54 of each rubber band 40 extends through a different lateral hole 28 of the stud plate wall 24 whereby securing the bands to the stud plate 20. Each band 40 also has an enlarged knot 48 formed on a second end 46 thereof whereby the second end 46 may be secured to the crutch 100 by jamming the knot 48 within the V-shaped juncture of a convergent pair of crutch arm support members 106 and 108. The stud plate 20 is secured to the crutch 100 by the longitudinal bias of the taught bands 40.

FIGS. 6–9 illustrate an alternate embodiment of the temporary crutch tip cleat assembly which is generally designated by the reference numeral 12. In this embodiment, the attachment means 60 comprises a generally horizontal circular band 62 for encircling a cylindrical crutch leg 102 which extends upwardly from the ground engaging tip 104. The band 62 has a longitudinal split 76 defining first and second ends 72 and 74 wherethrough the crutch leg 102 may pass during installation and removal of the crutch tip cleat assembly 12. The band 62 further has a resilient pad 66 disposed on an inside surface thereof for frictional engagement with the crutch leg 102 whereby preventing slippage of the band 62 on the crutch leg 102. The pad 66 also adapts the band 62 to fit snugly around various different crutch legs having slightly varying diameters.

Securement means 80, whereby the first and second band ends 72 and 74 may be drawn adjacent each other for securing the band 62 around the crutch leg 102, comprises a toggle latch 82 connected to the first end 72 of the band and a cooperable catch 84 connected to the second end 74 of the band.

A pair of generally vertical metal connecting linkages 64 connect the band 62 to the stud plate 20. The upper ends of the connecting linkages 64 are fixedly connected to opposing sides of the band 62 with a pair of rivets 68 while the lower ends of the connecting linkages 64 are fixedly connected to opposing sides of the stud plate wall 24 with a pair of rivets 68 such that the band 62 is fixed in spaced relationship directly above the stud plate 20.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A temporary crutch tip cleat assembly for preventing lateral slippage of a ground engaging tip of a crutch during use on icy and/or snowy supporting surfaces, the temporary crutch cleat assembly comprising:

a stud plate attachable to a ground engagement surface of a crutch tip for piercing engagement with ice and/or snow covered ground surfaces, the stud plate comprising a generally horizontal discoid plate formed of rigid material and having a plurality of sharp teeth projecting downwardly perpendicular to the major plane thereof, the plate also having a diameter corresponding to the outside diameter of the crutch tip, the plate further having straight wall sections extending around the circumference of said plate defining a cup-shaped receptacle wherein the crutch tip may be inserted for keeping the plate in alignment with the crutch tip, the wall having a pair of lateral holes formed through opposing sides thereof intermediate a wall rim and the discoid plate; and attachment means whereby the stud plate may be removably attached to the crutch, the attachment means comprising a pair of essentially identical resilient flexible bands, each band having a loop formed on a first end thereof, each loop extending through one of the lateral holes of the stud plate wall whereby securing the bands to the plate, each band also having an enlarged knot formed on a second end thereof whereby the second end may be secured to the crutch by jamming the knot within the V-shaped juncture of a convergent pair of crutch arm support members, the stud plate being secured to the crutch by the longitudinal bias of the taut bands.

2. The temporary crutch tip cleat assembly of claim 1 wherein the plate is formed of sheet metal.

3. The temporary crutch tip cleat assembly of claim 2 wherein the plurality of sharp teeth comprise integrally formed ragged burrs resulting from piercing of the sheet metal with a punch.

4. The temporary crutch tip cleat assembly of claim 3 wherein the resilient flexible bands are formed of rubber.

5. A temporary crutch tip cleat assembly for preventing lateral slippage of a ground engaging tip of a crutch during use on icy and/or snowy supporting surfaces, the temporary crutch cleat assembly comprising:

a stud plate attachable to a ground engagement surface of a crutch tip for piercing engagement with ice and/or snow covered ground surfaces, the stud plate comprising a generally horizontal discoid plate formed of rigid material and having a plurality of sharp teeth projecting downwardly perpendicular to the major plane thereof, the plate also having a diameter corresponding to the outside diameter of the crutch tip, the plate further having straight wall sections extending around the circumference of said plate to define a cup-shaped receptacle and a wall rim wherein the crutch tip, may be inserted for keeping the plate in alignment with the crutch tip, the wall having a pair of lateral holes formed through opposing sides thereof intermediate a wall rim and the discoid plate; and an attachment means whereby the stud plate may be removably attached to the crutch; said attachment means comprises:

a generally horizontal circular band for encircling a cylindrical crutch leg which extends upwardly from the ground engaging tip, the band having a longitudinal split defining first and second ends wherethrough the crutch leg may pass during installation and removal of the crutch tip cleat assembly, the band further having a resilient pad disposed on an inside thereof for frictional engagement with the crutch leg while simultaneously adapting the band to fit snugly around various different crutch leg having slightly varying diameter;

securement means whereby the first and second band ends may be drawn adjacent each other for securing the band around the crutch leg; and a pair of generally vertical connecting linkage each having upper and lower ends, the upper ends of the connecting linkages being fixedly connected to opposing sides of the band and the lower ends of the connecting linkages being fixedly connected to opposing sides of the stud plate wall such that the band is fixed in spacwherein ed relationship directly above the stud plate;

the plate is formed of sheet metal; and wherein the plurality of sharp teeth comprise integrally formed ragged burrs resulting from piercing of the sheet metal with a punch.

6. The temporary crutch tip cleat assembly of claim 5 wherein the securement means comprises a toggle latch connected to the first end of the band and a cooperable catch connected to the second end of the band.

7. The temporary crutch tip cleat assembly of claim 6 wherein the connecting, linkages are secured to the band and the stud plate wall with rivets.

* * * * *